US006892806B2

(12) United States Patent
Pantow et al.

(10) Patent No.: US 6,892,806 B2
(45) Date of Patent: May 17, 2005

(54) HEAT EXCHANGER FOR MOTOR VEHICLES

(75) Inventors: Eberhard Pantow, Stuttgart (DE); Arnoldt Rehm, Ditzingen (DE); Rainer Richter, Stuttgart (DE); Lubens Simon, Stuttgart (DE)

(73) Assignee: BEHR GmbH & Co., Stuttgart (DE)

( * ) Notice: Subject to any disclaimer, the term of this patent is extended or adjusted under 35 U.S.C. 154(b) by 0 days.

(21) Appl. No.: 09/881,122

(22) Filed: Jun. 15, 2001

(65) Prior Publication Data

US 2001/0052411 A1 Dec. 20, 2001

(30) Foreign Application Priority Data

Jun. 17, 2000 (DE) ..... 100 29 998

(51) Int. Cl.[7] ..... F28F 1/42; F28F 1/00; F28F 13/12

(52) U.S. Cl. ..... 165/179; 165/177; 165/109.1; 138/38

(58) Field of Search ..... 165/109.1, 179, 165/177; 138/38, 39

(56) References Cited

U.S. PATENT DOCUMENTS 3,664,928 A * 5/1972 Roberts ..... 138/38
4,470,452 A * 9/1984 Rhodes ..... 165/179
5,730,213 A * 3/1998 Kiser et al. ..... 165/148
5,803,162 A * 9/1998 Karbach et al. ..... 165/109.1
5,833,389 A * 11/1998 Sirovich et al. ..... 138/39
6,070,616 A 6/2000 Beck et al. ..... 138/38
6,321,835 B1 * 11/2001 Damsohn et al. ..... 165/109.1

FOREIGN PATENT DOCUMENTS

| | | | |
|---|---|---|---|
| DE | 196 54 367 | | 6/1998 |
| EP | 0 030 072 | | 6/1981 |
| GB | 2159265 | A * | 11/1985 |
| JP | 359125395 | A * | 7/1984 |
| JP | 363017393 | A * | 1/1988 |

* cited by examiner

*Primary Examiner*—Ira S. Lazarus
*Assistant Examiner*—Tho V Duong
(74) *Attorney, Agent, or Firm*—Foley & Lardner LLP

(57) ABSTRACT

The invention relates to a heat exchanger for motor vehicles, having a large number of flat tubes through which a liquid cooling medium can flow, and having corrugated fins which are associated with these flat tubes and to which environmental air or other media can be applied. The flat tubes having indentations pointing inward on at least one of their flat faces. Heat transfer between the core flow of the cooling medium and the flat tube walls is improved, and the power density of the heat exchanger is thus increased. The indentations are preferably in the form of elongated vortex generators.

20 Claims, 7 Drawing Sheets

HEAT EXCHANGER FOR MOTOR VEHICLES

BACKGROUND OF THE INVENTION

The invention relates to a heat exchanger, in particular for motor vehicles, having a large number of flat tubes through which a fluid cooling medium can flow, and having corrugated fins which are associated with these flat tubes and to which environmental air or other media can be applied.

EP 0 030 072 B1 discloses such a heat exchanger. The heat exchanger comprises a large number of flat tubes, through which coolant can flow, as well as corrugated fins which are associated with these flat tubes and to which environmental air can be applied. In this case, the flat tubes have indentations, with a very small indentation height. The indentations point inward on the flat faces of the tubes and are used to increase the robustness of the flat tubes. A heat exchanger such as this has the disadvantage that the coolant forms a hot core flow layer or stream within the flat tubes. This hot core flow is insulated from the flat tube walls by a cooler wall flow layer and exchanges little heat. As a result the amount of heat transferred between the core flow and the flat tube walls is low.

DE 196 54 367 A1 is mentioned here but is not believed to relate to the same field of use as the present invention. It discloses a rectangular tube for an exhaust gas heat exchanger equipped with elongated vortex generators that point inward in the form of winglets. The vortex generators, which are each arranged in pairs in a V-shape, are formed from the solid material of the tube and are positioned such that they diverge in the main exhaust gas flow direction. The vortex generators are used to reduce deposits on the inner walls of the tubes of solids—such as carbon black—contained in the exhaust gases. No further details are given of the dimensions of the vortex generators.

SUMMARY OF THE INVENTION

One object of the invention is to develop a heat exchanger of the type mentioned above, which provides improved heat transfer between the core flow of the cooling medium and the flat tube walls as well as increased power density.

In accomplishing the objects of the invention, there has been provided, according to one aspect of the invention a heat exchanger for motor vehicles comprising (a) a plurality of flat tubes through which a fluid cooling medium can flow, (b) elongated vortex generators in the form of indentations pointing inward on at least one flat face of said flat tubes and (c) corrugated fins to which environmental air or other media can be applied, operably linked to said flat tubes. The ratio between a height, h, of the vortex generators and a height, H, of the flat tubes is approximately 0.05 to 0.5. The longitudinal axes of the vortex generators are inclined at angles of approximately 10° to 40° with respect to the tube longitudinal axis. The vortex generators which are adjacent to one another transversely with respect to the longitudinal axis of the tube are inclined in opposite directions.

In accordance with another aspect of the present invention, there has been provided a heat exchanger for motor vehicles comprising (a) a plurality of flat tubes through which a fluid cooling medium can flow, (b) elongated vortex generators in the form of indentations pointing inward on at least one flat face of said flat tubes and (c) corrugated fins to which environmental air and other media can be applied, operably linked to said flat tubes. The ratio between a height, h, of the vortex generators and a height, H, of the flat tubes is approximately 0.05 to 0.5. The longitudinal axes of the vortex generators are inclined at angles of approximately 10° to 40° with respect to the tube longitudinal axis. The vortex generators which are adjacent to one another transversely with respect to the longitudinal axis of the tube are inclined in opposite directions. The flat tubes are beaded tubes, with a bead running parallel to the tube longitudinal axis.

According to another aspect of the present invention, there has been provided an automotive cooling system for an engine, comprising a cooling loop carrying an engine coolant and communicating with the engine, and a heat exchanger in the cooling loop, wherein the heat exchanger comprises a heat exchanger as defined above.

In accordance with an additional aspect of the invention, there is provided a motor vehicle embodying the engine cooling system according to the invention.

Further objects, features and advantages of the present invention will become apparent from the detailed description of preferred embodiments that follows when considered together with the accompanying drawings.

BRIEF DESCRIPTION OF THE DRAWINGS

The invention is described in detail below with reference to the exemplary embodiments and with reference to the accompanying drawings, in which.

DETAILED DESCRIPTION OF THE PREFERRED EMBODIMENTS

Figure 1:
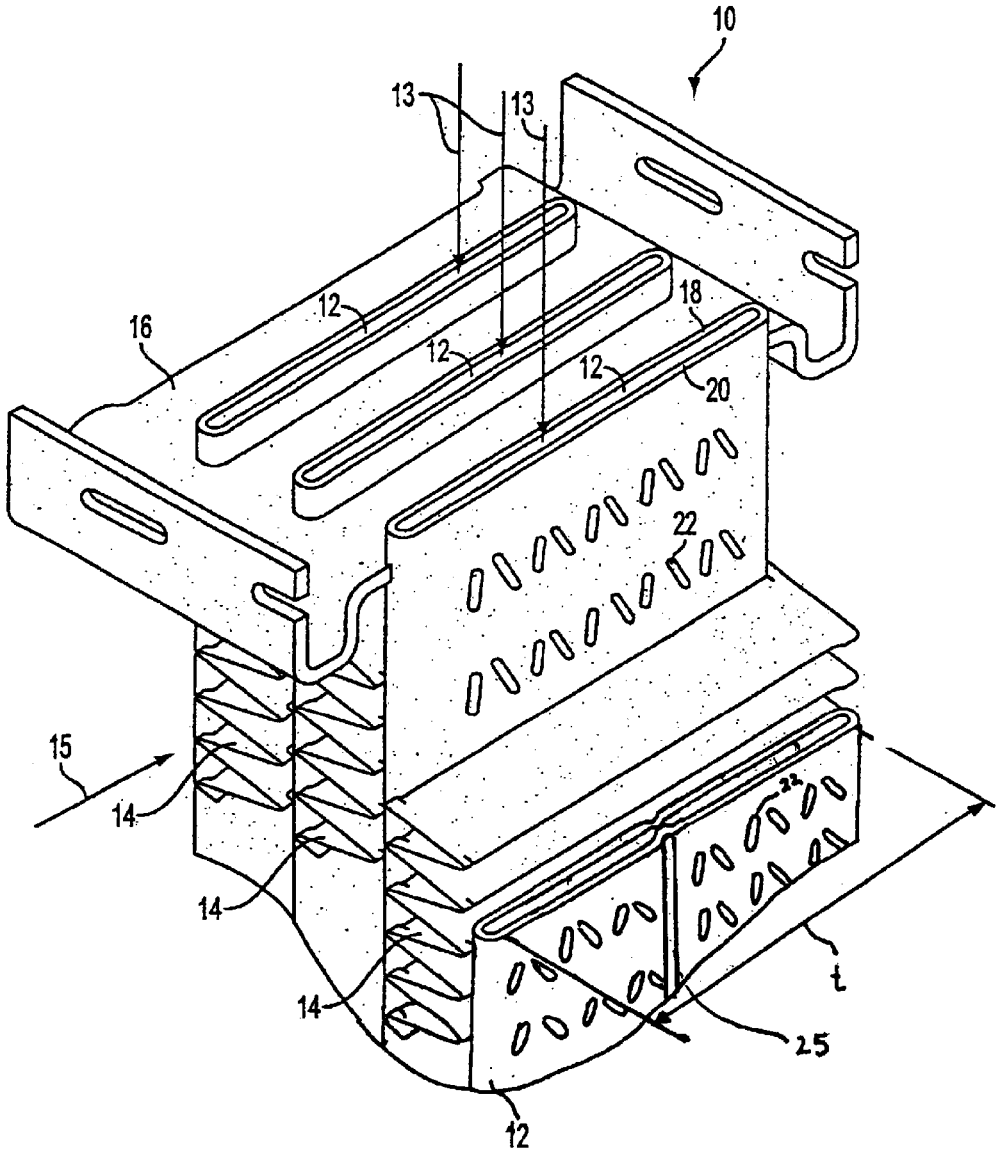
FIG. 1 shows a three-dimensional partial view of a heat exchanger according to the invention, having fins, flat tubes and tube bases.

The invention provides for the indentations to be in the form of elongated vortex generators with a longitudinal axis, and for the ratio between the height of the vortex generators and the height of the flat tubes to be approximately 0.05 to 0.5. The invention further provides for the longitudinal axes of the vortex generators to be inclined at angles of approximately 10° to 40° to the direction of the tube longitudinal axis. Additionally, the invention provides for adjacent vortex generators arranged in (i) an opposing direction and (ii) transversely with respect to the longitudinal axis of the tube. The vortex generators increase the turbulence of the coolant flow, thereby, depending on the sizes of the vortex generators, causing either (i) vortices to be formed or, at least, (ii) the boundary layer to be broken up. This improves the exchange between the various coolant layers.

A further aspect of the invention provides for the ratio between the height of the vortex generators and the height of the flat tubes to be approximately 0.05 to 0.25. Vortex generators with such dimensions function primarily to break up the boundary layer of the coolant flow, thereby ensuring improved exchange between the various coolant layers, with comparatively low pressure gradients.

Another preferred embodiment of the invention provides for the ratio between the height of the vortex generators and the height of the flat tubes to be approximately 0.25 to 0.5. Vortex generators with such dimensions deliberately produce longitudinal vortices due to their height and the elongated form. The vortex generators are inclined at angles relative to the tube longitudinal axis. These longitudinal vortices augment the thorough mixing of the individual coolant layers downstream because they move in a spiral shape in the tube longitudinal axis direction, and, thus, have transverse components in addition to the longitudinal movement.

An additional preferred aspect of the invention provides for the vortex generators to be arranged in vortex generator rows of, for example, at least three vortex generators which run transversely with respect to the tube longitudinal axis and are preferably essentially in straight lines. This aspect of the invention also provides, for example, a number of vortex generator rows arranged essentially in a straight line one behind the other in the direction of the tube longitudinal axis. This arrangement of the vortex generators, in the form of straight rows, allows the areas in which longitudinal vortices are produced to be defined accurately over the entire depth and width of the flat tube. Such an arrangement makes it possible to optimize the way in which the longitudinal vortices interact for specific coolant flow speeds or flow ranges and thereby enhance the thorough mixing. In this case, it has been found to be particularly advantageous for the ratio of (i) the distance between the vortex generator rows in the direction of the tube longitudinal axis to (ii) the length of the vortex generators to be approximately 1 to 10. It has further been found advantageous for the ratio of (i) the distance between the vortex generators, which are transverse with respect to the direction of the longitudinal axis of the tube to (ii) the length of the vortex generators to be approximately 0.1 to 0.9, preferably 0.2 to 0.8. In this context, the length of the vortex generators means the length projected transversely with respect to the tube longitudinal axis.

A further preferred embodiment of the invention provides for the capability to arrange the vortex generators on both flat faces of the flat tubes and for the respective vortex generator rows on the first flat face and on the second flat face to be arranged offset with respect to one another in the direction of the tube longitudinal axis. An arrangement of vortex generator rows such as this allows for mutual interference between the longitudinal vortices and, hence, further improvement in the thoroughness of mixing of the coolant layers. In addition, since the contact surface areas and hence the brazed surface areas are enlarged, the quality of the brazing between the flat tubes and the corrugated fins is improved. In this context it has been found to be particularly advantageous for the ratio between (i) the distance between the first flat face and the second flat face of the vortex generator rows in the direction of the tube longitudinal axis and (ii) the height of the vortex generators to be approximately 10 to 30.

Yet a further preferred embodiment of the invention provides for the vortex generator rows, which are adjacent in the longitudinal direction, to be arranged offset at an angle, β, of approximately 10° to 30°, preferably at or about 20°. The advantage of an arrangement offset in a manner such as this is that this results in the indentations forming a uniform pattern in the tube strip material. This is advantageous for production and for the fin-tube assembly, particularly its brazing, to be made more uniform. This can have a positive effect both on the strength of this joint and on the heat transfer, due to the homogenization of the heat flows.

Turning now to the figures, FIG. 1 shows a three-dimensional partial view of a heat exchanger 10 for use in motor vehicles, comprising flat tubes 12 through which a liquid coolant 13 can flow. This coolant 13 carries heat from a propulsion unit (engine), which is normally included but has not been illustrated here for the sake of clarity, to the heat exchanger 10. The heat exchanger 10 dissipates this heat via corrugated fins 14 to the environmental air 15, or to other media. In this case, the corrugated fins 14 are each arranged between the flat tubes 12, and the flat tubes are each held by a tube base 16 at their ends. The tube base 16 in turn forms a part of a collecting tank, which is normally included but has not been illustrated here for the sake of clarity. The collecting tank is connected to the internal combustion engine via hoses.

Figure 2:
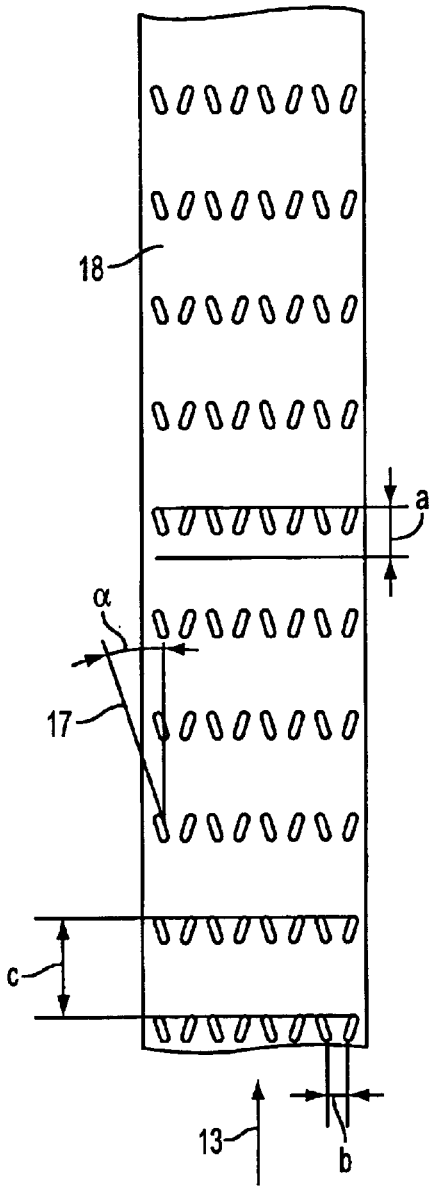
FIG. 2 shows a plan view of a first flat face, seen from the inside of the flat tube.
Figure 3:
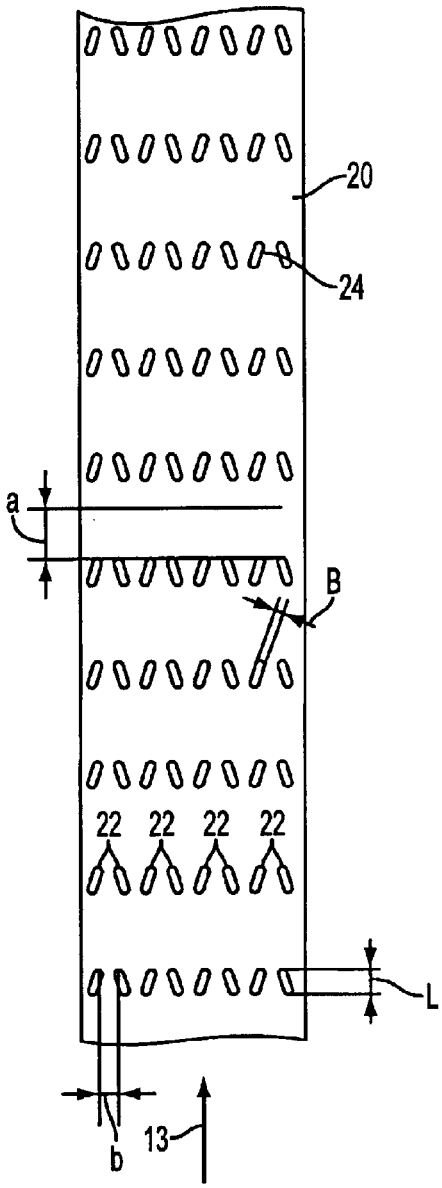
FIG. 3 shows a plan view of a second flat face, seen from inside the flat tube.
Figure 4:
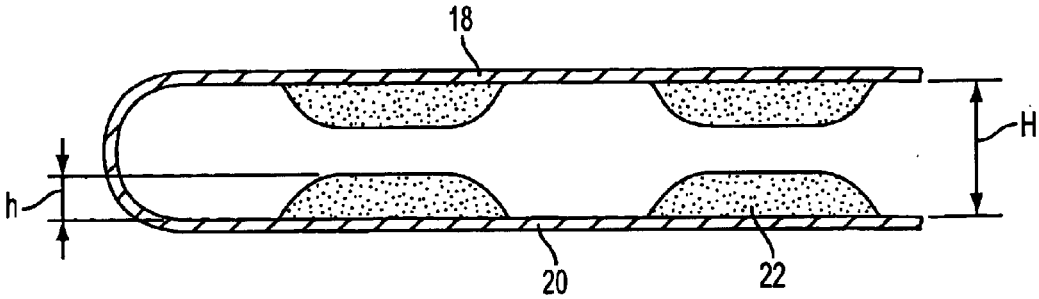
FIG. 4 shows a section illustration of a subregion of the flat tube, illustrated on a larger scale than in FIGS. 2 and 3.

The flat tubes 12 of the heat exchanger 10 have a relatively small flat tube internal height, H, for example 1 mm, as shown in FIG. 4, in comparison to a relatively large depth, t, FIG. 1. In this case, they have vortex generators 22 on both their first flat faces 18 and their second flat faces 20. The vortex generators 22 have a closed surface and are formed, for example, by rolling in the direction of the inside of the flat tubes 12. The flat tubes 12 of the heat exchanger 10 may be a beaded tube having a longitudinal bead 25 running parallel to the tube longitudinal axis. As illustrated in FIG. 2 and FIG. 3, the vortex generators 22 have an elongated form and are arranged in vortex generator rows 24 aligned transversely with respect to the tube longitudinal axis 13. A number of such vortex generator rows 24 are arranged one behind the other in the direction of the tube longitudinal axis 13. The ratio between (i) the distances, b, between the individual vortex generators 22 and (ii) the length, L, of the vortex generators (which is 3 mm, for example) is preferably, in this case, approximately 0.7, although this ratio may be in the range from 0.1 to 0.9, and preferably in the range from 0.2 to 0.8. The width of the vortex generators, B, is preferably 1.3 mm. The ratio between the distances, C, between the individual vortex generator rows 24 and the length, L, of the vortex generators is preferably approximately 4, although this value may be between 1 and 10.

The vortex generators 22 are preferably each inclined at an angle $\alpha$=20° to the tube longitudinal axis 13, although this angle may be between 10° and 40°. Vortex generators 22 which are, in each case, adjacent transversely with respect to the tube longitudinal axis 13 are preferably inclined in opposite directions. Two vortex generators are thus, in each case, arranged in pairs in a V-shape, with the two V-limbs diverging from one another in the direction of the tube longitudinal axis 13. The vortex generator height, h, is approximately ⅓ of the flat tube height, H, and is preferably 0.2 mm, although this ratio may also be between 0.3 and 0.7, so that the sum of the respective vortex generator heights, h, of the first flat faces 18 and of the second flat faces 20 may be greater than the flat tube height, H. This is made possible because the individual vortex generator rows 24 and 24' on the first flat faces 18 and on the second flat faces 20 are arranged offset with respect to one another. In this case, the ratio between (i) the distance between the vortex generator rows 24 on the two flat faces 18 and 20 and (ii) the vortex generator height, h, is approximately between 10 and 30.

Figure 5:
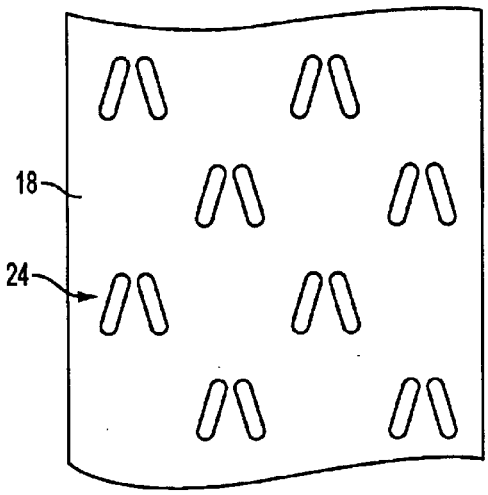
FIGS. 5 and 6 show illustrations as in FIGS. 2 and 3 of a further embodiment.
Figure 6:
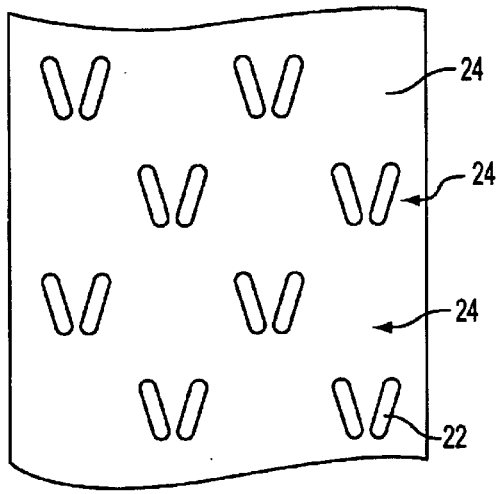

In an alternate embodiment of the invention which is illustrated in FIGS. 5 and 6, there are gaps between the vortex generator rows 24 so that, for example, pairs of vortex generators 22 in the row 24 may each be at greater distances from one another than the two vortex generators in a pair. Adjacent vortex generator rows 24 are arranged offset with a gap in this embodiment.

Figure 7:
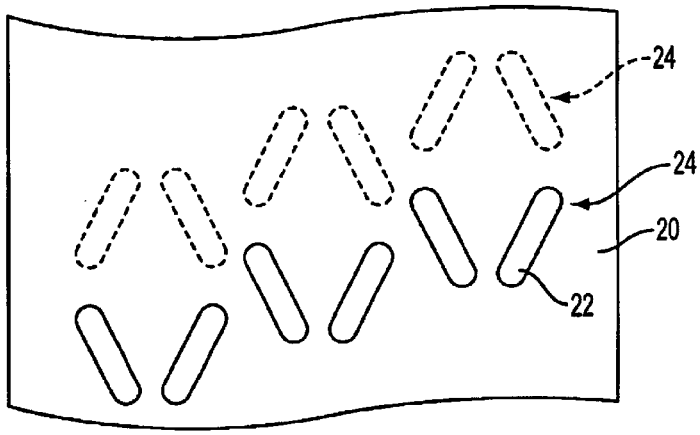
FIGS. 7 and 8 show illustrations as in FIG. 2 or 3 of further embodiments.

Another embodiment of the invention illustrated in FIG. 7 provides for the vortex generator rows 24 not to extend at right angles to the tube longitudinal direction, although they do extend transversely with respect to the tube longitudinal direction, with the individual vortex generator rows 24 running parallel to one another. This results in the uniform distribution of contact points of the corrugated fins 14 with zones where the heat transfer is high and is not limited to individual fins, as in the case of an arrangement at right angles depicted in FIGS. 2 and 3.

Figure 8:
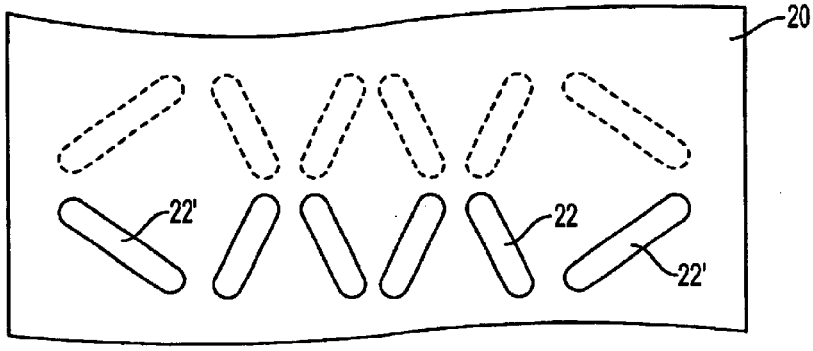

A further embodiment of the invention, illustrated in FIG. 8, provides for the angle of inclination on the outermost vortex generator 22' to be increased, thus improving the thoroughness of the mixing in the region of the narrow face of the flat tube 12, where it is not possible for any vortex generators to be arranged.

Figure 9:
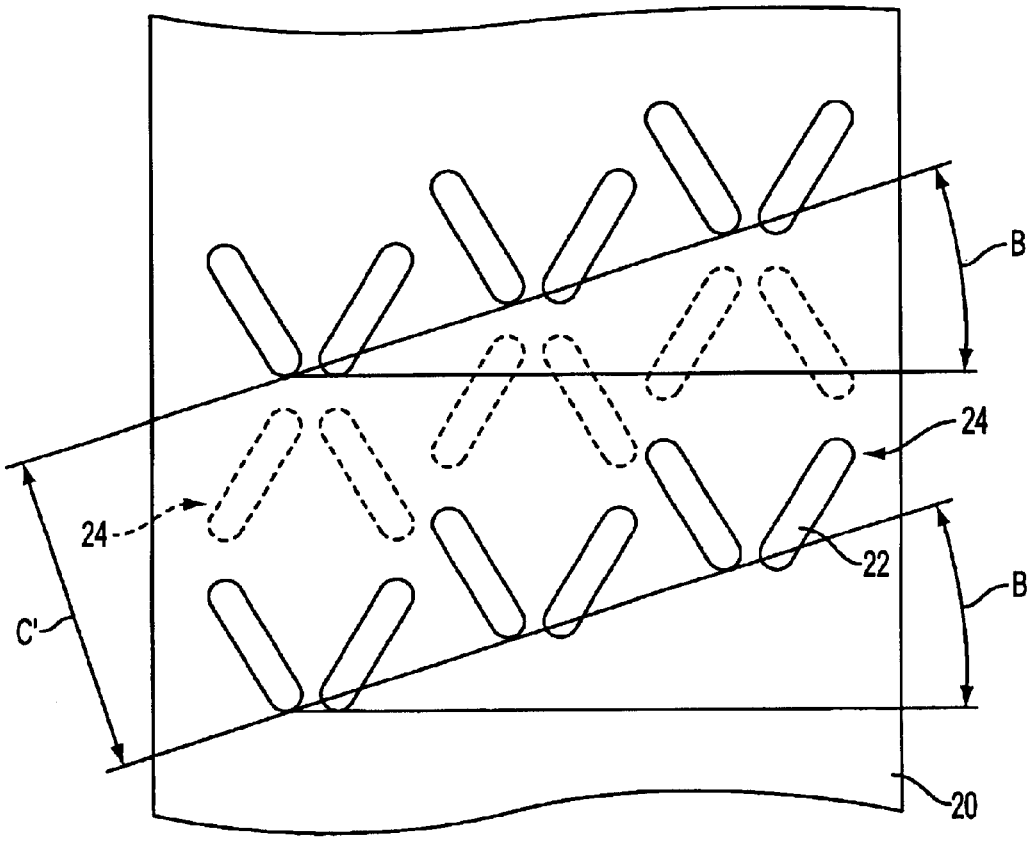
FIG. 9 shows an illustration as in FIG. 7, but with further details added.
Figure 10:
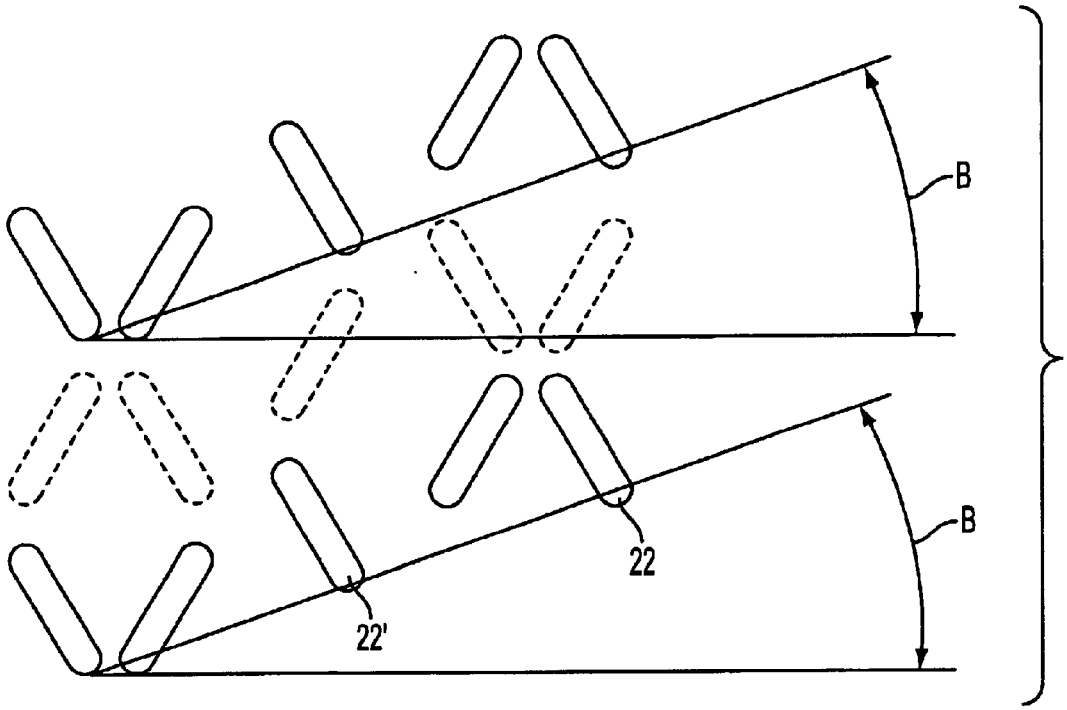
FIG. 10 shows an illustration as in FIG. 9, but with a modified geometry.
Figure 11:
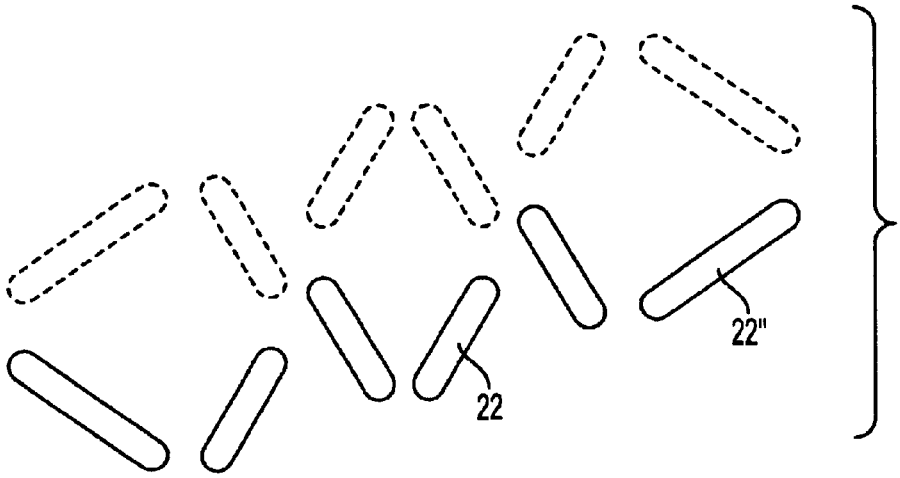
FIG. 11 shows an illustration as in FIG. 9, but with a modified geometry.
Figure 12:
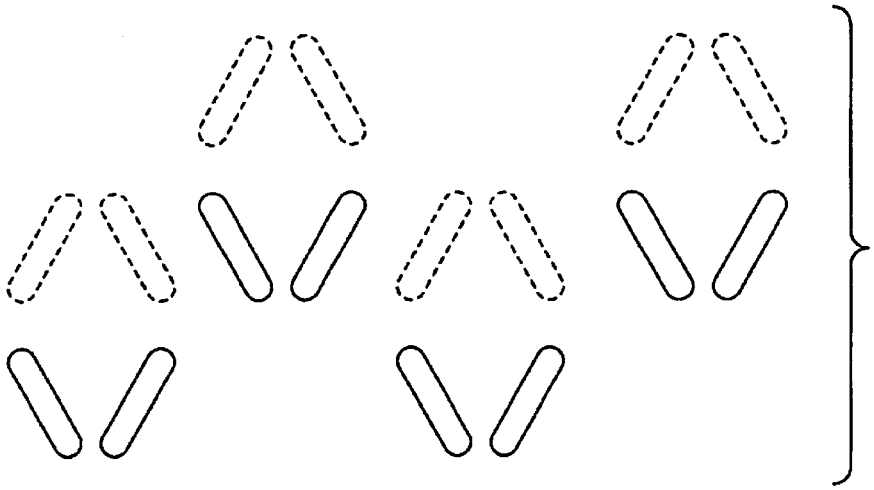
FIG. 12 shows an illustration as in FIG. 9, but with a modified geometry.

FIG. 9 shows another preferred embodiment corresponding to that in FIG. 7, with the vortex generator rows which are adjacent in the longitudinal direction being arranged offset at an angle, β, of 20° to one another. The distance C' between the vortex generator rows in this case is preferably 6 mm. Alternatively, as shown in FIG. 10, it is also possible to use a geometry in which the vortex generators 22 are supplemented by vortex generators 22' arranged between them. Furthermore, the vortex generators may also be split geometrically as shown in FIG. 11, with the vortex generators 22" which are located in the outer area being arranged offset with respect to the vortex generators 22.

Combinations of the various embodiments are, of course, also contemplated. In this case, for example, the values relating to the tube may be related to one face of a beaded tube, separated by a longitudinal bead.

Figure 13:
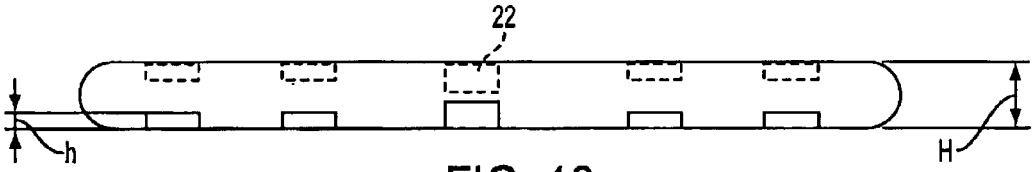
FIG. 13 shows a section illustration of a flat tube, with vortex generators arranged in a stepped form.
Figure 14:
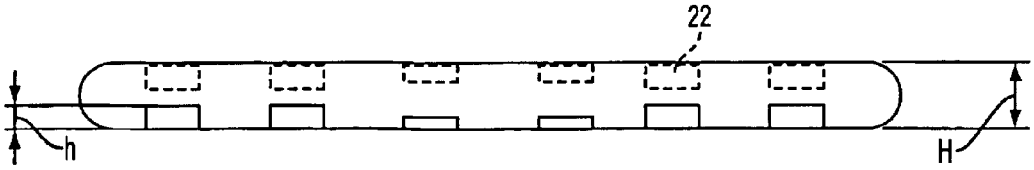
FIG. 14 shows a section illustration of a flat tube, with vortex generators arranged in a stepped form.
Figure 15:
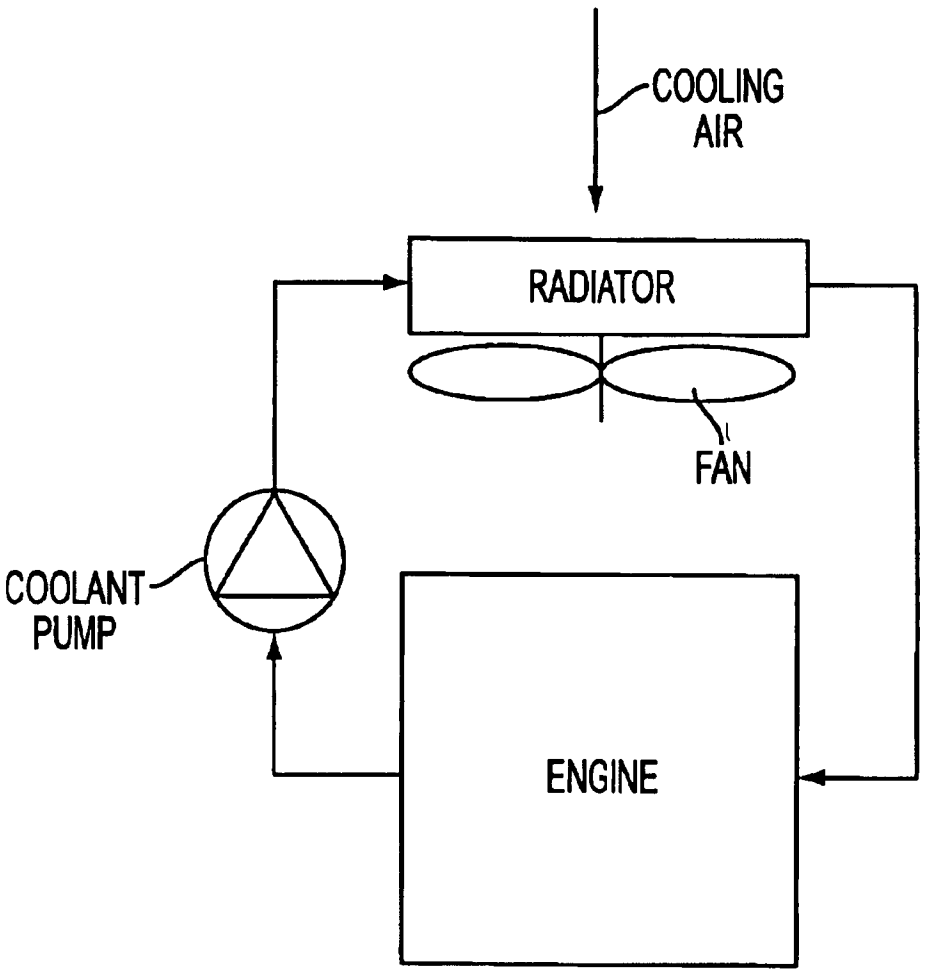
FIG. 15 shows a cooling loop carrying an engine coolant and communicating with the engine and a heat exchanger in the cooling loop.

FIG. 13 shows an embodiment in which the vortex generators each have different heights, h, relative to one another, resulting in a rising stepped form seen from inside the tube. By this means the power density in the central area is further increased, with the height of the vortex generators extending overall within the range 10% to 80% of half the height, H, of the flat tubes. A descending stepped form, illustrated as seen toward the inside of the tube in FIG. 14, is alternatively possible.

The disclosure of German Patent Application No. 100 29 998.9 filed Jun. 17, 2000 is hereby incorporated by reference in its entirety.

The foregoing embodiments have been shown for illustrative purposes only and are not intended to limit the scope of the invention which is defined by the claims.

What is claimed is:

1. A heat exchanger for motor vehicles comprising:

(a) a plurality of flat tubes through which a fluid cooling medium can flow;

(b) elongated vortex generators in the form of indentations pointing inward on at least one flat face of said flat tubes, and (i) wherein the ratio between a height, h, of the vortex generators and a height, H, of the flat tubes is approximately 0.05 to 0.5;

(ii) wherein a longitudinal axes of the vortex generators are inclined at angles of approximately 10° to 40° with respect to the tube longitudinal axis; and (iii) wherein vortex generators which are adjacent transversely with respect to the tube longitudinal axis are inclined in opposite directions; and (iv) wherein the ratio of the distance between the vortex generator rows in the direction of the tube longitudinal axis to the length of the vortex generators is about 1 to 10; and (v) wherein the ratio of the distance between the first flat face and the second flat face of the vortex generator rows in the direction of the tube longitudinal axis to the height of the vortex generators is approximately 10 to 30

(c) corrugated fins to which environmental air or other media can be applied operably linked to said flat tubes.

2. The heat exchanger as claimed in claim 1, wherein the ratio between the height, h, of the vortex generators and the height, H, of the flat tubes is approximately 0.05 to 0.25.

3. The heat exchanger as claimed in claim 1, wherein the ratio between the height, h, of the vortex generators and the height, H, of the flat tubes is approximately 0.25 to 0.5.

4. The heat exchanger as claimed in claim 1, wherein the vortex generators are arranged in vortex generator rows of at least three vortex generators and wherein said rows run transversely with respect to the tube longitudinal axis and essentially in straight lines.

5. The heat exchanger as claimed in claim 1, wherein a plurality of vortex generator rows are arranged one behind the other, in the direction of the tube longitudinal axis.

6. The heat exchanger as claimed in claim 1, wherein the ratio of (i) the transverse distance, b, between the vortex generators with respect to (ii) the tube longitudinal axis to the length, L, of the vortex generators is approximately 0.1 to 0.9.

7. The heat exchanger as claimed in claim 4, wherein the vortex generators are arranged on both flat faces of the flat tubes.

8. The heat exchanger as claimed in claim 7, wherein the vortex generator rows are arranged offset at an angle, β, of approximately 10° to 30° with respect to a line transverse to the tube longitudinal axis.

9. The heat exchanger as claimed in claim 1, wherein the flat tubes are beaded tubes, with a bead running parallel to the tube longitudinal axis.

10. The heat exchanger as claimed in claim 1, wherein the height of the vortex generators is 10% to 80% of half the height, H, of the flat tubes.

11. An automotive cooling system for an engine, comprising a cooling loop carrying an engine coolant and communicating with the engine, and a heat exchanger in the cooling loop, wherein the heat exchanger comprises a heat exchanger according to claim 1.

12. A motor vehicle comprising an engine and a cooling system for the engine, wherein the cooling system comprises a cooling system as defined by claim 11.

13. The heat exchanger as claimed in claim 7, wherein respective vortex generator rows on the first flat face and on the second flat face are arranged in alternating relationship with respect to one another in the direction of the tube longitudinal axis.

14. The heat exchanger as claimed in claim 7, wherein respective vortex generators in at least one row on the first flat face and in the row located at the same longitudinal position on the second flat face are arranged in alternating relationship with respect to one another, in the direction transverse to the tube longitudinal axis.

15. The heat exchanger as claimed in claim 13, wherein the vortex generator rows are arranged at an angle, $\beta$, of approximately 10° to 30° with respect to a line transverse to the tube longitudinal axis.

16. The heat exchanger as claimed in claim 7, wherein the vortex generators in respective rows are arranged essentially in straight lines behind one another in the direction of the tube longitudinal axis.

17. The heat exchanger as claimed in claim 15, wherein the vortex generators in respective rows are arranged essentially in straight lines behind one another in the direction of the tube longitudinal axis.

18. The heat exchanger as claimed in claim 17, wherein there are an odd number of vortex generators in each respective row.

19. The heat exchanger as claimed in claim 5, wherein the distance between adjacent vortex generator rows is 6 mm.

20. The heat exchanger as claimed in claim 8, wherein the distance between adjacent vortex generator rows is 6 mm and the angle $\beta$ is 20°.

* * * * *